US006914179B2

(12) United States Patent
Ahrens

(10) Patent No.: US 6,914,179 B2
(45) Date of Patent: Jul. 5, 2005

(54) FLUTES WITH MULTIPLE CHAMBERS THAT SHARE COMPOUND BISECTED TONEHOLES

(75) Inventor: Karl P. Ahrens, Bloomfield, CT (US)

(73) Assignee: Mountain Ocarinas Inc., Bloomfield, CT (US)

( * ) Notice: Subject to any disclaimer, the term of this patent is extended or adjusted under 35 U.S.C. 154(b) by 34 days.

(21) Appl. No.: 10/423,667

(22) Filed: Apr. 25, 2003

(65) Prior Publication Data

US 2004/0003702 A1 Jan. 8, 2004

Related U.S. Application Data

(60) Provisional application No. 60/375,926, filed on Apr. 25, 2002, and provisional application No. 60/388,471, filed on Jun. 12, 2002.

(51) Int. Cl.[7] ..... G10D 7/02

(52) U.S. Cl. ..... 84/384; 84/380 R; 84/381; 84/386

(58) Field of Search ..... 84/384, 380 R, 84/381, 386, 377, 378

(56) References Cited

U.S. PATENT DOCUMENTS 2,145,605 A 1/1939 Mausolf ..... 84/380
2,485,749 A * 10/1949 Ladd ..... 84/384
3,815,466 A * 6/1974 Johnson ..... 84/380 R
4,821,670 A * 4/1989 Foxcroft et al. ..... 116/137 R
4,893,541 A * 1/1990 Fowler et al. ..... 84/380 C

OTHER PUBLICATIONS http://www.ne.jp/asahi/suimin/japan/doublet e.htm.

* cited by examiner

*Primary Examiner*—Shih-Yung Hsieh
(74) *Attorney, Agent, or Firm*—McCormick, Paulding & Huber LLP

(57) ABSTRACT

One exemplary embodiment of a flute comprises first and second chambers in which sound is resonated and a tonehole disposed at and shared by the first and second chambers. The tonehole is coverable by a single finger of an operator's hand and is configured to facilitate airflow communication from the first chamber through the tonehole and airflow communication from the second chamber through the tonehole. An exemplary embodiment of an ocarina comprises an instrument body having a first chamber having a first airway through which air is received and a second chamber having a second airway through which air is received, a top cover disposed on the instrument body, an upper tonehole disposed through the top cover to facilitate airflow through the first chamber and airflow through the second chamber, and a bottom cover disposed on the instrument body. Another embodiment of a flute comprises first and second chambers in which sound is resonated, a blowing aperture through which air is provided into the first and second chambers, and a tonehole disposed at and shared by the first and second chambers.

27 Claims, 3 Drawing Sheets

FLUTES WITH MULTIPLE CHAMBERS THAT SHARE COMPOUND BISECTED TONEHOLES

CROSS REFERENCE TO RELATED PATENT APPLICATION

The present application claims the benefits of U.S. Provisional Patent Application Ser. No. 60/375,926, filed Apr. 25, 2002, entitled Extended-Range Two-Chambered Ocarinas With a Shared Set of Compound Bisected Toneholes, and U.S. Provisional Patent Application Ser. No. 60/388,471, filed Jun. 12, 2002, entitled Double Fipple Flutes With a Shared Set of Compound Bisected Toneholes, which are incorporated herein by reference in their entirety.

FIELD OF THE PRESENT INVENTION

The present invention relates generally to musical flutes, and is more specifically directed to flutes with multiple sound chambers and toneholes that are shared between the sound chambers.

BACKGROUND OF THE PRESENT INVENTION

A flute is a type of wind instrument in which the impingement of air on an edge as the air passes into a sound chamber causes the air to oscillate to produce an audible tone. Two categories of flutes include tubular flutes (such as the modern Boehm flute, the recorder, the tin whistle, the quena, etc.) and vessel flutes (such as the ocarina). Tubular flutes generally employ sound chambers having an open end. The sound chamber bore of a tubular flute is relatively long and slender and is shaped (or substantially shaped) like a tube or a truncated cone. The cross sectional dimension across the direction in which the bore extends may or may not be round. Furthermore, tubular flutes can be divided into fipple flutes, such as the recorder or tin whistle, which employ an airway to focus air over an edge, and other types of flutes in which the player focuses air directly onto an edge through their lips. Vessel flutes such as the ocarina, in contrast, use enclosed sound chambers that may be of several different shapes but that are generally shorter and wider than those of tubular flutes. Ocarinas are also considered fipple flutes because they focus air onto an edge using an airway. Other types of vessel flutes can be constructed without an airway.

Tubular flutes in general, but especially keyless tubular flutes (in which the toneholes are covered with the player's fingers instead of with some type of pad), suffer from certain weaknesses that are addressed by this present invention. (Examples of keyless flutes are recorders, tin whistles, traditional Irish flutes, fifes, quenas, etc.) A common limitation of flutes is that the lowest playable notes are often very quiet and much quieter than some of the higher playable notes. Players of keyless flutes wishing to perform without the aid of electronic amplification may find their instrument lacking in sound volume, especially when accompanied by other instrumentalists. While such flutes can be specifically designed to produce more sonorous low notes in the first octave, doing so usually limits the range of notes obtainable in the second or third octaves. At the same time, a flute designed to emit a strong lower register is often quite shrill in the upper register(s) because the player is forced to blow relatively hard to obtain notes in the upper register. Another weakness of some prior art keyless flutes is that the upper octaves tend to be out of tune (i.e., flat) in relation to the bottom octave. Still another weakness of some prior art keyless flutes is their tendency to "squawk" or jump the octave on the lower notes without the novice player intending to do so. A player is often forced to blow quite softly on the lower notes to avoid this problem. Similarly, higher notes can be difficult to reach.

Vessel flutes such as ocarinas also suffer from certain limitations that can be alleviated by this present invention. Prior art ocarinas generally play from about one octave to as much as one octave and three or four notes. Nevertheless, the vessel flutes cannot be overblown to produce another octave or two as can many of the tubular flutes. At the same time, many ocarinas that produce a wide range of notes relative to other ocarinas suffer from very quiet low notes and relatively shrill or excessively airy high notes. Just as in the case of tubular flutes, designing an ocarina to produce strong low notes will limit the range and quality of its upper notes. Therefore, despite the beauty of tone and ease of play of certain better quality ocarinas, many educators and musicians have indicated a desire for a wider tonal range that would allow ocarinas to play a greater body of music.

Ocarinas with a range of two octaves have been constructed by combining two separate ocarinas pitched approximately one octave apart (a high octave and a low octave) into one ocarina. (While most ocarinas possess a single airway, a single fipple window, a single sound chamber, and a single set of toneholes, prior art ocarinas also include multi-chambered ocarinas with multiple airways, multiple fipple windows, and multiple sets of toneholes.) Each chamber of a multi-chambered ocarina has its own set of toneholes, which typically number four. The fingering pattern for a two-chambered ocarina produces a nearly-chromatic one octave scale for each ocarina using just the four toneholes associated with that chamber. In such an ocarina, four fingers of the right hand control the four toneholes of one chamber and four fingers of the left hand control the four toneholes of the other chamber. The problem with this design is that the one-handed non-linear (i.e., crossfingering) fingering pattern of these ocarinas is unsuitable for faster or more technically challenging music, being relatively slow, awkward, and entirely unlike the traditional woodwind fingerings used on the clarinet, flute, and saxophone. In fact, the basic scale is both anti-intuitive and not very helpful to learners who may later play another instrument in the woodwind family. In another case, a two-octave ocarina, also having two combined ocarinas pitched about one octave apart, can be constructed using a linear fingering pattern similar to that used by most members of the woodwind family. Unfortunately, players of such ocarinas are faced with the daunting task of moving their fingers from one set of toneholes to a separate set each time they wish to cross from one octave to another.

SUMMARY OF THE PRESENT INVENTION

Disclosed herein are flutes with two (or more) sound chambers, both of which share the same set of compound bisected toneholes. One exemplary embodiment of such a flute comprises first and second chambers in which sound is resonated and a bisected tonehole disposed at and shared by the first and second chambers. The bisected tonehole is coverable by a single finger of an operator's hand and is configured to facilitate airflow communication from the first chamber through the bisected tonehole and airflow communication from the second chamber through the bisected tonehole. The tonehole may be bisected by a partition wall. Alternately, the tonehole may comprise a recess and may be bisected by separate openings disposed in airflow communication with each chamber.

An exemplary embodiment of an ocarina comprises an instrument body having a first chamber having a first airway through which air is received and a second chamber having a second airway through which air is received, a top cover disposed on the instrument body, an upper bisected tonehole disposed through the top cover to facilitate airflow through the first chamber and airflow through the second chamber, and a bottom cover disposed on the instrument body. As above, the bisected tonehole is coverable by a single finger of an operator's hand.

Another embodiment of a flute having a shared tonehole comprises first and second chambers in which sound is resonated, a blowing aperture through which air is provided into the first and second chambers, and a bisected tonehole disposed at the first and second chambers. As in the previous embodiments, the bisected tonehole is coverable by a single finger of an operator's hand.

In still another embodiment, a flute comprises first and second chambers in which sound is resonated and a bisected tonehole disposed at and shared by the first chamber and the second chamber. In such an embodiment, the bisected tonehole comprises a first opening disposed in the recess and in airflow communication with the first chamber and a second opening disposed in the recess and in airflow communication with the second chamber. The recess is coverable by a single finger of an operator's hand.

In any embodiment, each bisected tonehole is actually two separate toneholes that allow the two separate chambers to function as a single easy-to-play, coordinated musical instrument because an operator can easily control the pitches of both sound chambers without having to move his or her fingers from one set of toneholes to another. In essence, two flutes are combined into one, but the operator only has to control one set of toneholes. The bisected tonehole, when covered and uncovered by an operator playing the instrument, allows air blown into either the first chamber or the second chamber to flow through one side or the other of the bisected tonehole (or through both sides at once), thereby producing a musical tone.

Combining two ocarinas pitched approximately one octave apart and having toneholes that are shared between chambers can result in an instrument having an extended tonal range and an easy linear fingering pattern. A linear (i.e., non-crossfingering) fingering pattern not only mimics the fingering patterns of major woodwinds such as the flute, clarinet, and saxophone but is also extremely simple, agile, and intuitive, allowing musicians to play faster, more technically challenging music. In addition, each of the two combined ocarinas can be specifically designed to play either an optimal lower octave or an optimal higher octave.

Combining two tubular flutes of the same key can improve both the strength of the lower notes and the tone and range of the upper notes. Makers of single-chambered flutes are forced to compromise between optimal sound quality in the lower register and optimal sound in the upper register because a single sound chamber bore must be designed to meet the varying demands of both registers. The present invention reduces the need for such compromise by combining two separate sound chambers, one of which is designed specifically to optimize the sound of the lower register and the other of which is designed specifically to optimize the sound of the upper register. Likewise, tuning between the upper and lower registers can also be improved because the separate upper register chamber can be designed to play in tune with the lower chamber. Furthermore, the lower register sound chamber can be designed so as not to jump (or over blow) the octave, while the upper register sound chamber can be designed so that it will not play the lower octave. In this way, players can blow harder in the lower register to produce more sound and can blow softer in the upper register. Novices would not produce "squawking" sounds on the low notes by blowing too hard, and high notes would be easier to reach with less blowing pressure and shrillness. In fact, musicians will be able to vary their blowing pressure more in either register, which lends itself to greater expressiveness.

Based on the foregoing, it is the general object of the present invention to facilitate the creation of flutes, especially keyless flutes, that improve upon the limitations of the prior art flutes.

DETAILED DESCRIPTION OF THE PREFERRED EMBODIMENT

Figure 1:
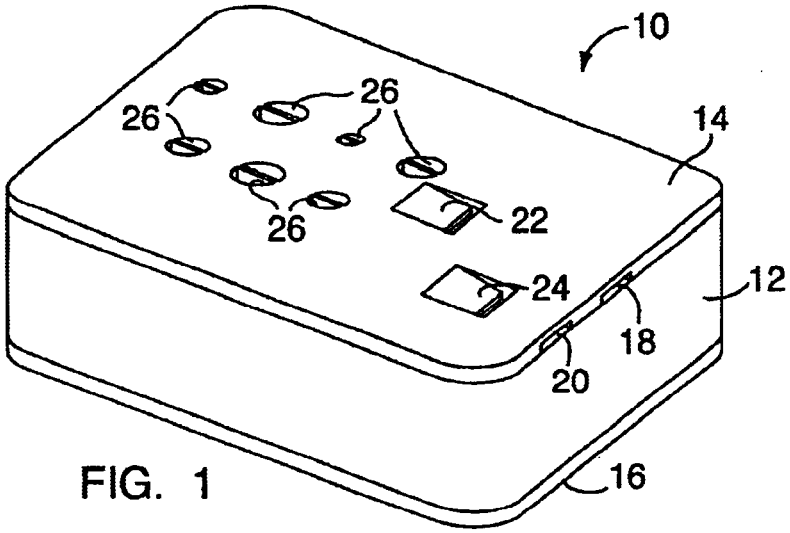
FIG. 1 is a perspective view of a two-chambered ocarina having compound bisected toneholes.

Referring to FIG. 1, one exemplary embodiment of a flute having a compound bisected tonehole is shown generally at 10. The term "flute" is intended to indicate a musical instrument in which the impingement of air on an edge as the air passes into a sound chamber causes the air to oscillate to produce an audible tone. The term "tonehole" is intended to indicate a hole that, when selectively obstructed (covered or uncovered), allows pressure to be relieved in a sound chamber, thus varying the pitch of a musical tone. The term "compound bisected tonehole" is intended to indicate two separate toneholes, each facilitating airflow communication from a separate sound chamber of a multi-chambered flute, that are combined to form one compound bisected tonehole, the compound bisected tonehole being so arranged as to be coverable by a single finger. In other words, each bisection of the bisected tonehole is in communication with its corresponding sound chamber and is a separate tonehole, but the two bisections are appropriately shaped and placed side by side so that both bisections can be simultaneously covered by a single finger of the operator's hand. Hence, the operator does not move his or her fingers to a separate set of toneholes when switching from playing one chamber to the other. Although the flute is shown as and is hereinafter referred to as being an ocarina ("ocarina 10"), it should be understood that the principles described below are applicable to a variety of open-holed wind instruments including, but not limited to, the recorder, the tin whistle, the quena, and the fife.

As shown, the ocarina 10 is configured to have an extended range in the key of C and includes an instrument body 12, a top cover 14, and a bottom cover 16. The top cover 14 and the bottom cover 16 are perforated with a plurality of apertures that facilitate airflow communication through first and second inner chambers enclosed by the instrument body 12, the top cover 14, and the bottom cover 16. The apertures include a first airway 18 through which air is received into the first chamber, a second airway 20 through which air is received into the second chamber, a first fipple window 22 from which at least a portion of the air received into the first chamber is expelled, a second fipple window 24 from which at least a portion of the air received into the second chamber is expelled, and at least one compound bisected tonehole. Although the first fipple window 22 and the second fipple window 24 are shown as being disposed in the top cover 14, it should be understood that either or both may be disposed in the bottom cover 16. Upper toneholes 26 may extend through the top cover 14, whereas lower toneholes 28 (FIG. 2) may extend through the bottom cover 16. At least one and preferably a plurality of the upper toneholes 26 is a compound bisected tonehole.

As air is forced through the first airway 18 or the second airway 20, the air in the corresponding chamber of the instrument body 12 oscillates to produce a sound wave having a frequency and an amplitude. When the upper compound bisected toneholes 26 or the lower toneholes 28 associated with their respective chambers are selectively obstructed during the forcing of air into the chamber, the frequency and amplitude at which the air in the instrument body oscillates is varied, thereby producing tones of varying pitches. The obstruction of the upper compound bisected toneholes 26 is effected by an operator placing his or her fingers over the upper compound bisected toneholes 26 to fully or partially close the openings. Likewise, the obstruction of the lower toneholes 28 is effected by an operator placing his or her thumbs over the lower toneholes 28 to fully or partially close those openings.

Figure 2:
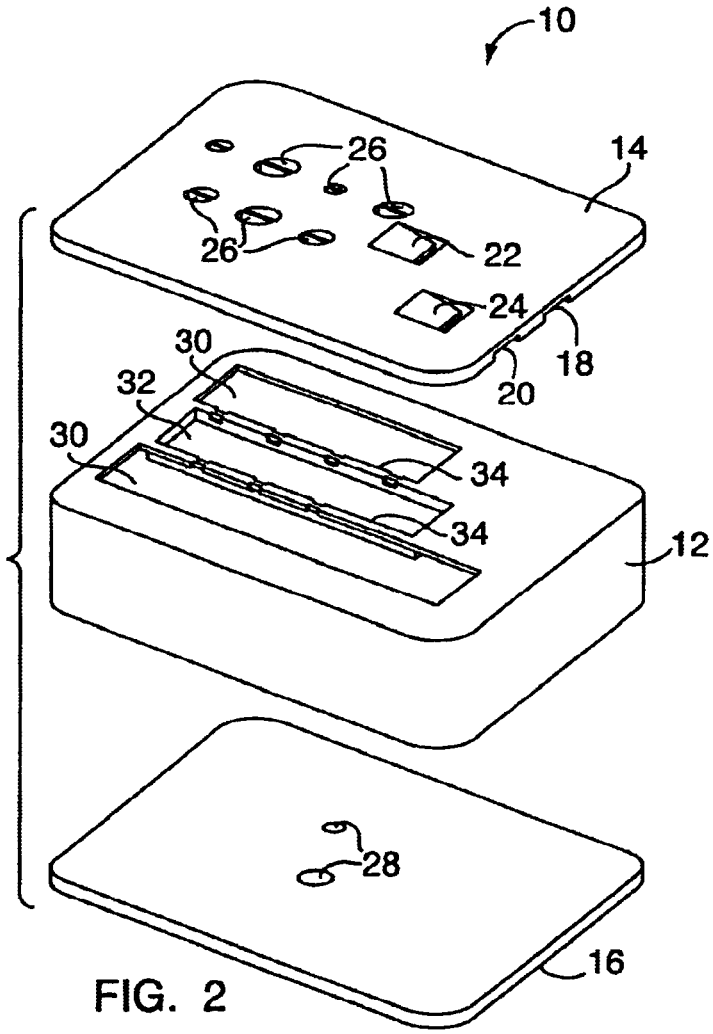
FIG. 2 is an exploded perspective view of the ocarina of FIG. 1 showing a nesting of the two chambers.

In the exemplary embodiment of the ocarina 10 shown with reference to FIG. 2, the first chamber is shown at 30, and the second chamber is shown at 32. The first chamber 30 is a volume enclosed by the instrument body 12, the top cover 14, and the bottom cover 16. The second chamber 32 is a volume enclosed by the instrument body 12 and the top cover 14. The chambers are nested, i.e., the second chamber 32 is disposed within but is isolated from the first chamber 30 such that the second chamber 32 is at least partially surrounded by the first chamber 30. Thus, airflow communication is maintained throughout the first chamber 30 around and/or under the second chamber 32.

The first chamber 30 and the second chamber 32 are separated from each other via partition walls 34 formed in the instrument body 12. The first chamber 30 is preferably of a different volume than the second chamber 32 and is dimensioned so as to provide the ocarina 10 with the ability to sound tones that are at least one octave apart. As is shown, the first chamber 30 is greater in volume than the second chamber 32 and is capable of sounding the lower octave.

The top cover 14 includes a plurality of openings that define the upper compound bisected toneholes 26, the first airway 18, the second airway 20, the first fipple window 22, and the second fipple window 24. The bottom cover 16 includes one or a plurality of openings that define the lower toneholes 28. Both the top cover 14 and the bottom cover 16 are configured to cooperate with the instrument body 12 such that, when the ocarina 10 is assembled, the first chamber 30 and the second chamber 32 are enclosed.

As stated above, at least one and preferably a plurality of upper toneholes 26 are compound bisected toneholes, i.e., shared by the first chamber 30 and the second chamber 32 to facilitate airflow communication individually through the first chamber 30 and through the second chamber 32. In some cases, at least one of the lower toneholes 28 may also be shared by the first chamber 30 and the second chamber 32. By sharing the toneholes between the chambers, each compound bisected tonehole becomes a fully functioning tonehole for each chamber, thereby allowing a person playing the ocarina 10 to play the lower octave with substantially the same fingering pattern as the upper octave. The term "substantially the same fingering pattern" is intended to indicate that the fingering pattern is identical for the lower and the upper octaves with the exception that the highest notes of the upper octave may be fingered differently from the highest notes of the lower octave in some embodiments. The partition walls 34 are thinner at the edge portions thereof over which the openings that define the upper toneholes 26 (or the lower toneholes 28) are positioned. The upper compound bisected toneholes 26 are dimensioned so as to accommodate the fingers of a person playing the ocarina 10. Likewise, the lower toneholes 28 are dimensioned so as to accommodate the thumbs of a person playing the ocarina 10.

Figure 3:
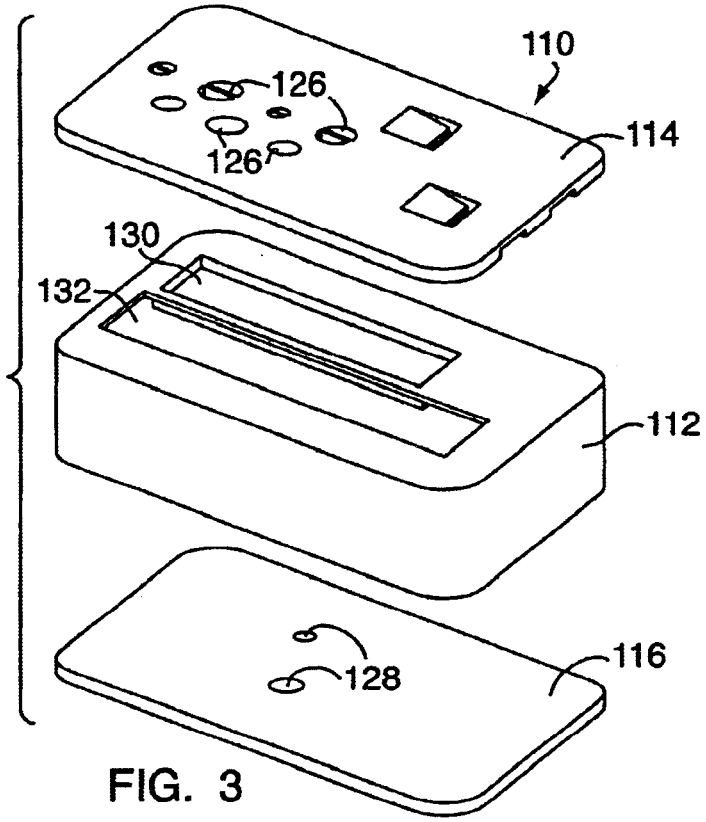
FIG. 3 is an exploded perspective view of an ocarina in which two chambers are positioned side-by-side.

In one alternate embodiment, an ocarina may be differently keyed (e.g., keyed in the key of F) as is shown at 110 with reference to FIG. 3 such that a first chamber 130 and a second chamber 132 may be positioned side-by-side in an instrument body 112. The instrument body 112 of the ocarina 110 may be enclosed by a top cover 114 and a bottom cover 116. In such an embodiment, portions of the first chamber 130 may extend into the second chamber 132 to facilitate the creation of compound bisected upper toneholes 126. Furthermore, in embodiments in which the chambers are positioned side-by-side and in which both chambers are of equal depths, the lower toneholes 128 may also be bisected and shared between chambers.

Figure 4:
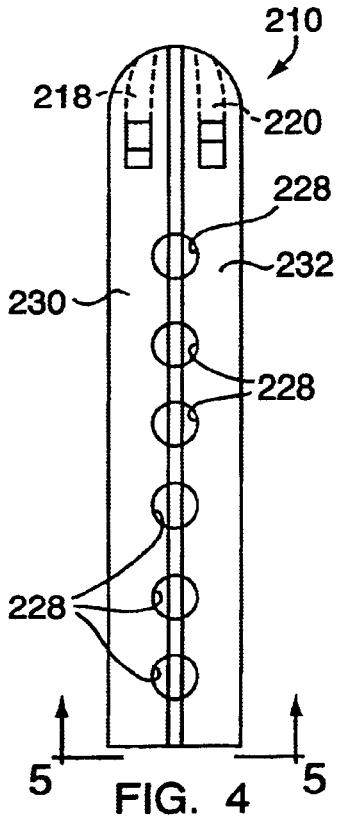
FIG. 4 is a plan view of a flute having two chambers positioned side-by-side and having compound bisected toneholes.
Figure 5:
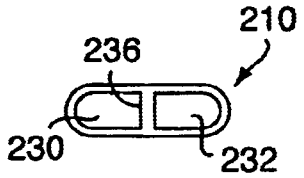
FIG. 5 is a cross-sectional view of the two chambers of the flute of FIG. 4.

In another alternate embodiment, as is shown with reference to FIGS. 4 and 5, a tubular flute 210 may be configured to have a first chamber 230 and a second chamber 232 positioned side-by-side to define an instrument body having a round, elliptical, or angular cross-sectional geometry taken perpendicular to the axial direction in which the first chamber 230 and the second chamber 232 extend. Compound bisected toneholes 228 are disposed across a partition wall 236 disposed between the first chamber 230 and the second chamber 232. The flute 210 utilizes the dual-chamber configuration to increase the volume of the sound produced by the flute 210. Air may be received into the first chamber 230 and the second chamber 232 via any suitable type of airway configuration. One suitable airway configuration comprises a first airway 218 and a second airway 220 positioned proximate each other such that both can be blown into at the same time, as is shown.

Figure 6:
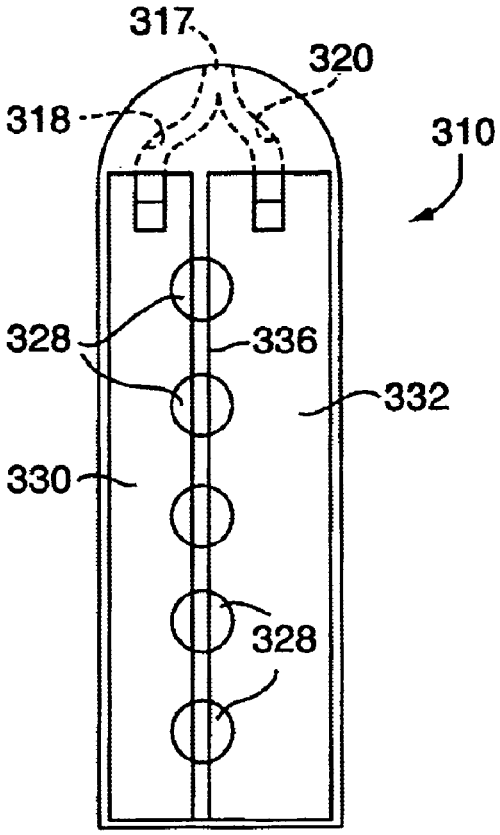
FIG. 6 is a plan view of a flute having two chambers positioned side-by-side and having a common blowing aperture.

Another suitable airway configuration includes two airways having a common blowing aperture, as is shown in FIG. 6, so that a person playing the flute (shown at 310) blows into only one opening and both chambers simultaneously receive the airflow. In such a configuration, the common blowing aperture 317 directs an airstream into both a first airway 318 and a second airway 320. A first chamber 330 and an adjacently-positioned second chamber 332 simultaneously receive the airstream. As above, the flute 310 utilizes the dual-chamber configuration to provide a sound of increased volume. Toneholes 328 disposed across a partition wall 336 disposed between the first chamber 330 and the second chamber 332 allow the operator to produce the desired notes.

Other suitable airway configurations include, but are not limited to, a sliding mouthpiece that translates between two airways to focus the air into one chamber or the other, a single blowing aperture that cooperates with a thumb- or finger-operated mechanism to shunt air into one airway or the other or directly into one chamber or the other, and the like. Embodiments in which an airstream is selectively focused into one or the other chamber additionally allow for the optimization of both chambers such that the lower octave can be very strong and the upper octave(s) can be wider ranging and produce more pleasing tones with less of the undesirable shrillness sometimes associated with the playing of the upper octave(s).

Figure 7:
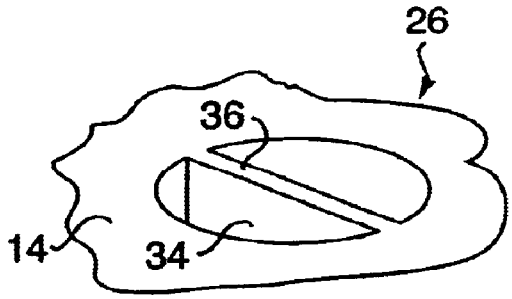
FIG. 7 is a perspective view of a compound bisected tonehole.

Referring now to FIG. 7, one exemplary embodiment of an upper tonehole 26 is shown. The upper tonehole 26 is defined by an opening in the top cover 14 of the ocarina (or the shell or bore of any flute) and is coverable by a single finger of an operator's hand. The opening is bisected by a cross member 36 that extends chordally across the opening and engages an upper edge of the partition wall 34 that separates the first and second chambers in the ocarina. The bisections of the opening may or may not be of equal areas. Each bisected upper tonehole 26 is a fully functioning tonehole for either the first or the second chamber thus allowing the ocarina player to play the lower octave with substantially the same fingering pattern and substantially the same compound bisected upper toneholes 26 as the upper octave. Although only an upper compound bisected tonehole 26 is shown, it should be understood that lower toneholes of separate chambers may also be combined and bisected.

Figure 8:
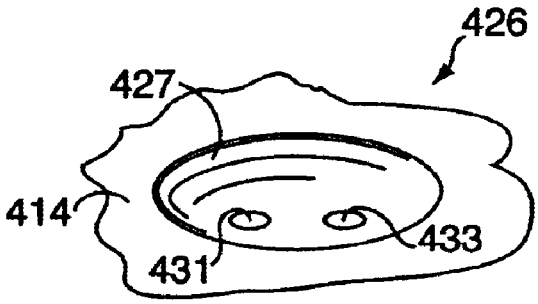
FIG. 8 is a perspective view of an alternate embodiment of a compound bisected tonehole.

Referring now to FIG. 8, another exemplary embodiment of an upper tonehole is shown at 426. The upper tonehole 426 comprises a recess 427 disposed in an outer surface 414 of an ocarina (or the shell or bore of any flute). A first opening 431 is disposed in the recess 427 to provide airflow communication from the first chamber of the ocarina, and a second opening 433 is disposed in the recess 427 to provide airflow communication from the second chamber of the ocarina. As in the previously-described embodiment, the first opening 431 and the second opening 433 each define a fully functioning tonehole for either the first-or second chamber, respectively, of the ocarina. Also as above, the recess 427 is coverable by a single finger of the operator's hand.

Referring back to the embodiments shown in FIGS. 1 and 2, the dual chamber configuration defines two fully functioning ocarinas. The difference in the volumes of each chamber enable each chamber to be pitched one octave apart. In particular, the larger chamber has a lower pitch, whereas the smaller chamber has a pitch that is one octave higher than the pitch of the lower chamber. Depending upon the key in which the ocarina 10 is made, the ocarina 10 may have a tonal range of up to two octaves or more. Furthermore, by blowing softly, a note that is one half step below the fundamental note can be sounded from the first chamber 30. Alternately, an additional tonehole may be disposed in the ocarina 10 to allow a note one half step below the note in which the ocarina 10 is keyed to be sounded. Moreover, the first chamber 30 is capable of sounding two notes above the lower octave by selectively uncovering the corresponding lower tonehole 28 on the lower cover 16. Thus, in the key of C ocarina 10, there are three middle notes (C, D, and E) that overlap the two octaves and can be sounded from either the first (bigger) chamber 30 or the second (smaller) chamber 32. Such overlapping notes, though not essential, can be included for the purpose of facilitating a smooth transition between the lower and upper octaves.

In one exemplary technique of playing the key of C ocarina 10 (shown with reference to FIGS. 1 and 2), a linear fingering pattern is used. This fingering pattern, which is similar to the fingering patterns used by the major woodwinds, is referred to as linear because the right hand is placed below the left hand on major woodwind instruments such as the clarinet or saxophone. To sound the basic scale, the operator proceeds in a straight line from the fourth finger to the index finger on the right hand and then does the same on the left hand, with the exception of the fourth finger on the left hand. The row of upper toneholes 26 on the right side of the top cover 14 is covered by the fingers of the operator's right hand, and the row of upper toneholes 26 on the left side of the top cover 14 is covered by the fingers of the operator's left hand. The lower tonehole 28 on the right side of the bottom cover 16 is covered by the right thumb, and the lower tonehole 28 on the left side of the bottom cover 16 is covered by the left thumb. The operator blows into the first airway 18 to sound the notes of the first octave and into the second airway 20 to sound the second octave. The following is a description of a linear fingering pattern for an ocarina in the key of C. The low C (or "do") is played by covering the four right hand compound bisected toneholes with the fingers of the right hand, the three left hand compound bisected toneholes with the fingers of the left hand (not including the fourth finger), and the thumbholes with the thumbs. The D (or "re") is sounded by lifting the right fourth finger (R1) off its corresponding tonehole. The E (or "mi") is sounded by lifting the right third finger (R2) in addition to R1. The F is sounded by lifting the right middle finger (R3) in addition to R1 and R2. The G is sounded by lifting the right index finger (R4) in addition to R1, R2, and R3. The A is sounded by lifting the left third finger (L1) in addition to R1, R2, R3, and R4. The B is sounded by lifting the left middle finger (L2) in addition to the R1, R2, R3, R4, and L1. The middle C is sounded by lifting the left index finger (L3) in addition to R1, R2, R3, R4, L1, and L2. The middle C can also be sounded by covering all seven of the top compound bisected toneholes again and directing air into the second airway, which connects to the upper octave sound chamber.

The other two overlapping notes between the two octaves may be played by selectively obstructing the lower toneholes 28. In particular, the middle D may be sounded from the first chamber by uncovering all of the upper toneholes 26 on the top cover 14 of the ocarina 10 and uncovering the lower tonehole 28 under the right thumb. The middle E may be sounded by uncovering all of the upper toneholes 26 and both of the lower toneholes 28. To sound the notes of the upper octave, the operator blows into the second chamber while raising his or her fingers to uncover the corresponding upper toneholes 26 in the same pattern as for the lower octave. In the preferred embodiment of the invention, the second chamber does not sound the high D and high E above the second octave and therefore does not utilize the lower toneholes 28 for that purpose.

Other extended-range ocarinas having compound bisected toneholes, e.g., the key of F ocarina as is shown in FIG. 3, also utilize a linear fingering pattern that is substantially the same as the fingering pattern for the key of C ocarina 10. The term "substantially the same" is intended to indicate that the fingering pattern may be different because such an ocarina may not have as many notes in the upper octave, and the highest one or two notes may have a slightly different fingering than that of the key of C ocarina 10.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims. For example, although the above description is directed to an ocarina, it should be understood by those of skill in the art that aspects of the above-described apparatus may be applicable to flutes other than ocarinas.

What is claimed is:

1. A flute, comprising:

a first chamber in which sound is resonated;

a second chamber in which sound is resonated; and a bisected tonehole disposed at and shared by said first chamber and said second chamber, said bisected tonehole being configured such that a first bisected portion facilitates airflow communication only through said first chamber and a second bisected portion facilitates airflow communication only through said second chamber, said bisected tonehole being coverable by a single finger of an operator's hand.

2. The flute of claim 1, wherein said bisected tonehole is bisected by a partition wall disposed across said tonehole.

3. The flute of claim 1, wherein said bisected tonehole comprises a recess disposed in an outer surface defining at least one of said first chamber and said second chamber and wherein said tonehole is bisected by a first opening disposed in said recess and in airflow communication with said first chamber and a second opening disposed in said recess and in airflow communication with said second chamber.

4. The flute of claim 1, further comprising a first airway through which air is received into said first chamber, a second airway through which air is received into said second chamber, a first fipple window from which at least a portion of the air received into said first chamber is expelled, and a second fipple window from which at least a portion of the air received into said second chamber is expelled.

5. The flute of claim 4, wherein said first airway and said second airway are configured to receive an airflow through a common blowing aperture.

6. The flute of claim 1, wherein said first chamber and said second chamber are enclosed by an instrument body, a top cover, and a bottom cover.

7. The flute of claim 6, wherein said bisected tonehole extends through said top cover.

8. The flute of claim 6, wherein said bisected tonehole extends through said bottom cover.

9. The flute of claim 1, wherein said second chamber is disposed within said first chamber.

10. The flute of claim 1, wherein said second chamber is disposed adjacent to said first chamber.

11. The flute of claim 1, wherein said first chamber and said second chamber are dimensioned so as to sound a pitch that is one octave apart.

12. An ocarina, comprising:

an instrument body, comprising, a first chamber having a first airway through which air is received, and a second chamber having a second airway through which air is received;

a top cover disposed on said instrument body;

an upper bisected tonehole disposed through said top cover to facilitate airflow through said first chamber and airflow through said second chamber; and a bottom cover disposed on said instrument body.

13. The ocarina of claim 12, wherein said upper bisected tonehole is bisected by a partition wall that separates said first chamber and said second chamber.

14. The ocarina of claim 12, wherein said upper bisected tonehole comprises a recess disposed in said top cover and wherein said tonehole is bisected by a first opening disposed in said recess to provide airflow communication from said first chamber and a second opening disposed in said recess to provide airflow communication from said second chamber, said recess being coverable by a single finger of an operator's hand.

15. The ocarina of claim 12, wherein said first airway and said second airway receive air through a common blowing aperture.

16. The ocarina of claim 12, further comprising a lower compound bisected tonehole disposed through said bottom cover to facilitate airflow communication through said first chamber, said second chamber, or both said first chamber and said second chamber.

17. The ocarina of claim 12, further comprising a first fipple window disposed in communication with said first chamber, said first fipple window providing airflow communication from said first airway through said first chamber.

18. The ocarina of claim 12, further comprising a second fipple window disposed in communication with said second chamber, said second fipple window providing airflow communication from said second airway through said second chamber.

19. The ocarina of claim 12, wherein said second chamber is disposed within said first chamber.

20. The ocarina of claim 12, wherein said second chamber is disposed adjacent to said first chamber.

21. A flute, comprising:

a first chamber in which sound is resonated;

a second chamber in which sound is resonated;

a blowing aperture through which air is provided into said first chamber and said second chamber; and a bisected tonehole disposed at and shared by said first chamber and said second chamber, said tonehole being configured to facilitate airflow communication from said first chamber through said tonehole and airflow communication from said second chamber through said tonehole.

22. The flute of claim 21, wherein said tonehole is bisected by a partition wall disposed across an opening to bisect said opening into a first bisected portion and a second bisected portion, said first bisected portion of said bisected opening being in airflow communication with said first chamber and said second bisected portion of said bisected opening being in airflow communication with said second chamber.

23. The flute of claim 21, wherein said bisected tonehole comprises a recess disposed in an outer surface of said flute and wherein said tonehole is bisected by a first opening to provide airflow communication from said first chamber and a second opening to provide airflow communication from said second chamber.

24. A flute, comprising:

a first chamber in which sound is resonated;

a second chamber in which sound is resonated; and a bisected tonehole disposed at and shared by said first chamber and said second chamber, said bisected tonehole comprising a recess coverable by a single finger of an operator's hand, said tonehole being bisected by a first opening disposed in said recess and in airflow communication with said first chamber and a second opening disposed in said recess and in airflow communication with said second chamber.

25. The flute of claim 24, further comprising a first airway through which an airflow is received into said first chamber and a second airway through which an airflow is received into said second chamber.

26. The flute of claim 25, further comprising a first blowing aperture through which air is received into said first airway and a second blowing aperture through which air is received into said second airway.

27. The flute of claim 25, further comprising a common blowing aperture through which air is received into said first airway and said second airway.

* * * * *